US005415552A

United States Patent [19]

Harmon et al.

[11] Patent Number: 5,415,552

[45] Date of Patent: May 16, 1995

[54] FORCE REACTION AND RESETTING MECHANISM

[76] Inventors: Dennis W. Harmon, 1414 W. Busch Blvd., Tampa, Fla. 33612; John M. Cherry, P.O. Box 13403, Tampa, Fla. 33681-3403

[21] Appl. No.: 152,890

[22] Filed: Nov. 16, 1993

Related U.S. Application Data

[63] Continuation of Ser. No. 959,556, Oct. 13, 1992, abandoned.

[51] Int. Cl.[6] ..... A63B 69/22

[52] U.S. Cl. ..... 434/251; 434/247; 273/55 A; 482/87; 482/90

[58] Field of Search ..... 434/251, 258, 247, 256; 273/55 A; 482/83, 87, 90, 33

[56] References Cited

U.S. PATENT DOCUMENTS

| | | | |
|---|---|---|---|
| 547,731 | 10/1895 | MacLearn | 482/90 X |
| 704,265 | 7/1902 | McMaster | 273/55 A |
| 931,818 | 8/1909 | Valentine | 482/83 |
| 1,007,311 | 10/1911 | Pons | 482/87 |
| 1,663,659 | 3/1928 | Hart et al. | 273/55 A |
| 1,995,495 | 3/1935 | Barnick | 482/90 X |
| 2,466,954 | 4/1949 | King | 273/55 A |
| 2,913,245 | 11/1959 | Landis | 273/55 A |
| 3,427,021 | 2/1969 | Donato | 482/83 |
| 4,903,966 | 2/1990 | Liao | 482/90 X |

*Primary Examiner*—Gene Mancene
*Assistant Examiner*—Jeffrey A. Smith

[57] ABSTRACT

Disclosed is a force reaction and resetting mechanism utilized in contact sports training. The device has a rigid support member, a reaction/resetting mechanism, comprised of a compression element fixed between supports and held on the periphery of said supports by flexible restraints, a rigid anchoring member and a resilient cover.

6 Claims, 5 Drawing Sheets

FORCE REACTION AND RESETTING MECHANISM

This is a continuation of application Ser. No. 07/959,556, filed Oct. 13, 1992 and now abandoned.

This invention relates to but is not limited to contact athletic training appliances. Its main object being an improved blocking, tackling dummy for use in conditioning athletes in training, timing and technique and for safe and proper instruction in football blocking and tackling and martial arts. The mechanism utilized in the invention is adaptable for use in exercise equipment and other force resistant or imparting applications.

BACKGROUND—DESCRIPTION OF PRIOR ART

Historically for training in football at all levels of competition, there have been blocking sleds, hand held dummies/pads and hanging dummies (bags) for beth blocking and tackling. In addition, there has been some special equipment to train players for running and ball holding skills. Springs, when utilized in this equipment, have been plain flat, leaf, compression and extension springs. Compression coil springs when used have been confined and not held under flexible restraints thus limiting the action of the spring to compression without bending. Much of present equipment is cumbersome and cannot be relocated by one individual. Many of the present football training devices have exposed support structures which are a safety hazard to the athletes. Most cannot readily be arranged in multiple formations to simulate actual playing impact conditions and be run through by a player resetting immediately for another player.

OBJECTIVES OF THE INVENTION

One of our main objects is the provision of a dummy having improved body structure to withstand wear and impact. Also, to be light weight and movable from mounting socket to mounting socket by individuals and be withdrawn for storage.

Another object is the provision of a coil compression spring and the like restrained in such a way that it permits freedom of movement of the dummy body in all directions when force is applied while protecting the athletes from injury from contact with the restrained spring mechanism.

Another of our objects is the provision that the dummy simulate football blocking/tackling practice and the like. Also, that the dummy fight back in a manner that tends to quickly reset itself in its original position.

An additional object is to allow for various sizes and shapes of dummies to be used with the same reaction mechanism.

A primary object of our invention is to utilize standard parts in its fabrication and make the impact resistance of the dummy adjustable using the same restrained compression element.

Another object is the provision that the dummy can be socket mounted and anchored in a variety of locations and further can be mounted overhead as well as in the ground or floor.

Another object is to allow for various arrangements of dummies for football team blocking/tackling practice to match or approximate the opponents size and defensive positions. Due to the resetting ability of the dummies, practice team blocking can be platooned allowing use of more players in the same exercise.

One of the most important objects of our invention is to prevent injury and improve the morale of players that would normally be used in place of the blocking dummies either in uniform or holding blocking pads and standing dummies.

SUMMARY OF THE INVENTION

We have invented a blocking dummy that fights back and closely resembles the yield of an opposing defender and tends to quickly right itself. Our invention can be "run through" to simulate actual playing conditions where the blocker is running at an opponent at the time of impact. The reaction mechanism of our invention contained within the dummy can be adjusted to present various levels of reaction to impact and is protected on all sides by padding preventing player injuries.

We provide a rigid support member and reaction mechanism, a blocking/tackling/martial arts dummy of resilient material on the supporting member, anchoring means adapted to fasten the assembly to the earth or a base in a plurality of positions. Upon application of sufficient normal force to the rigid support, the assembly of the rigid support and reaction mechanism and bag provided will deflect and/or release of said force return to the original position. The reaction mechanism we provide consists of a standard coil compression spring or the like with flush ground ends mounted over sleeves and between flanges. The flanges are held snug to the coil compression spring compression element or the like by a plurality of adjustable or fixed flexible restraints such as chain or wire rope or the like placed around the outside of the spring and fastened to the flanges. The top member, top flange and top sleeve is one solid steel fabricated assembly utilizing standard plate and pipe or tube. The anchoring member, bottom flange and bottom sleeve is also a solid fabricated assembly. The anchoring socket is a piece of pipe, tube, structure or the like sized for a snug fit with the anchoring member to the anchoring socket depending on the application and particular location to which the dummy is set.

Having in mind these objects and the foregoing general description which set out the foregoing general description which set out the purposes and advantages of our invention, we will now refer to the drawings.

BRIEF DESCRIPTION OF THE DRAWINGS

FIG. 2-A is a side vertical section of the apparatus demonstrated in FIG. 2.

FIG. 3-A is a side vertical section of the design demonstrated in FIG. 3.

SPECIFIC DESCRIPTION OF PREFERRED EMBODIMENT

Figure 1:
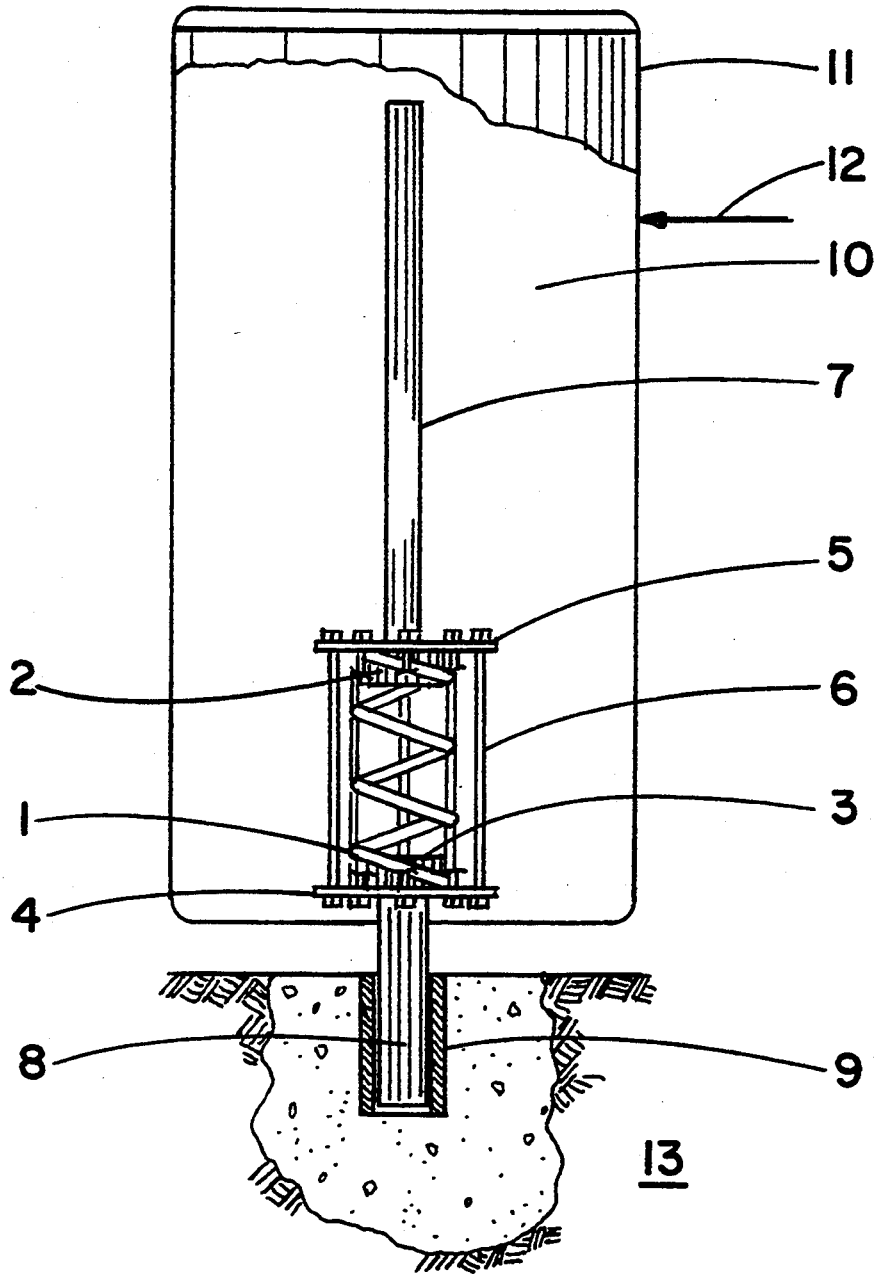
FIG. 1 is a vertical section through a cylindrical football and/or martial arts bottom anchored apparatus constructed in accordance with the present invention.

Referring to the drawings in FIG. 1 we have illustrated a cover 11 enclosing padding 10, all surrounding a vertical top member 7 and the following restrained compression spring assembly. The vertical top member 7 is provided with a flange base 5 and coil spring mount sleeve 2. A coil spring 1 is set over mount sleeve 2 between the top flange 5 and the bottom flange 4 over mounting sleeve 3. The foregoing assembly is held together by a plurality of fixed or adjustable flexible restraints 6 spaced around the perimeter of the flanges 5 and 4. To this is attached an anchoring member 8 and the whole dummy assembly set in anchoring socket 9 securely anchored in the earth or structure or the like 13.

When external axial force 12 strikes the cover 11 it is opposed by the padding 10, vertical top member 7 and the spring 1 which is held by restraints 6 so that the spring 1 is forced to compressive condition on the side opposite to external force 12. If the force 12 is sufficient to exceed the compressive strength of the spring 1, the spring 1 will compress and bend towards the side opposite the force 12 and the dummy will move in the direction of the force 12 in proportion to the amount of force 12. Upon the release of the force 12, the spring 1, vertical top member 7, padding 10 and cover 11 will quickly return to its original position due to the dampening effect of the restraints 6 and be held there by the restraints 6. The amount of normal force required to move the dummy will vary according to the size of the dummy, physical characteristics of the spring 1, the number and the placement of restraints 6 and the amount the spring 1 is compressed between flanges 5 and 4 by the restraints 6.

In the embodiment shown in FIG. 2, we have illustrated a cover 11 enclosing padding 10 all surrounding a bottom support structure 27 and the restrained compression spring assembly described in FIG. 1 as follows. The vertical top support 28 is provided with a flange 5 and coil spring mount sleeve 2. The coil spring 1 is set over mount sleeve 2 between the top flange 5 and the bottom flange 4 over mount sleeve 3. The foregoing assembly is held together by a plurality of fixed or adjustable flexible restraints 6 spaced peripherally around flanges 4 and 5 external to the spring 1. To this is an anchoring member 9 and the whole dummy assembly set in anchoring sleeve 34 and secured in place by a pin 35 or the like can be set in a number of holes 36 in the vertical top support 28. All of the foregoing is securly anchored in the earth or to a structure or the like 13.

When external axial force 12 strikes the cover it is opposed by the padding 10, bottom support structure 27 and the spring 1 which is held by restraints 6 so that the spring 1 is forced to a compressive condition on the side opposite to the external force. If the force is sufficient to exceed the compressive strength of spring 1 it will compress and bend towards the side opposite the force 12 in proportion to the amount of force 12. Upon the release of the force 12, the spring 1, bottom support structure 27, padding 10 and cover 11 will quickly return to its original position due to the dampening effect of the restraints 6 and be held there by the restraints 6. The amount of external axial force 12 required to move the dummy will vary according to the size and shape of the dummy, physical characteristics of the spring 1, the number and placement of restraints 6 and the amount spring 1 is compressed between flanges 4 and 5 by the restraints 6.

Figure 2:
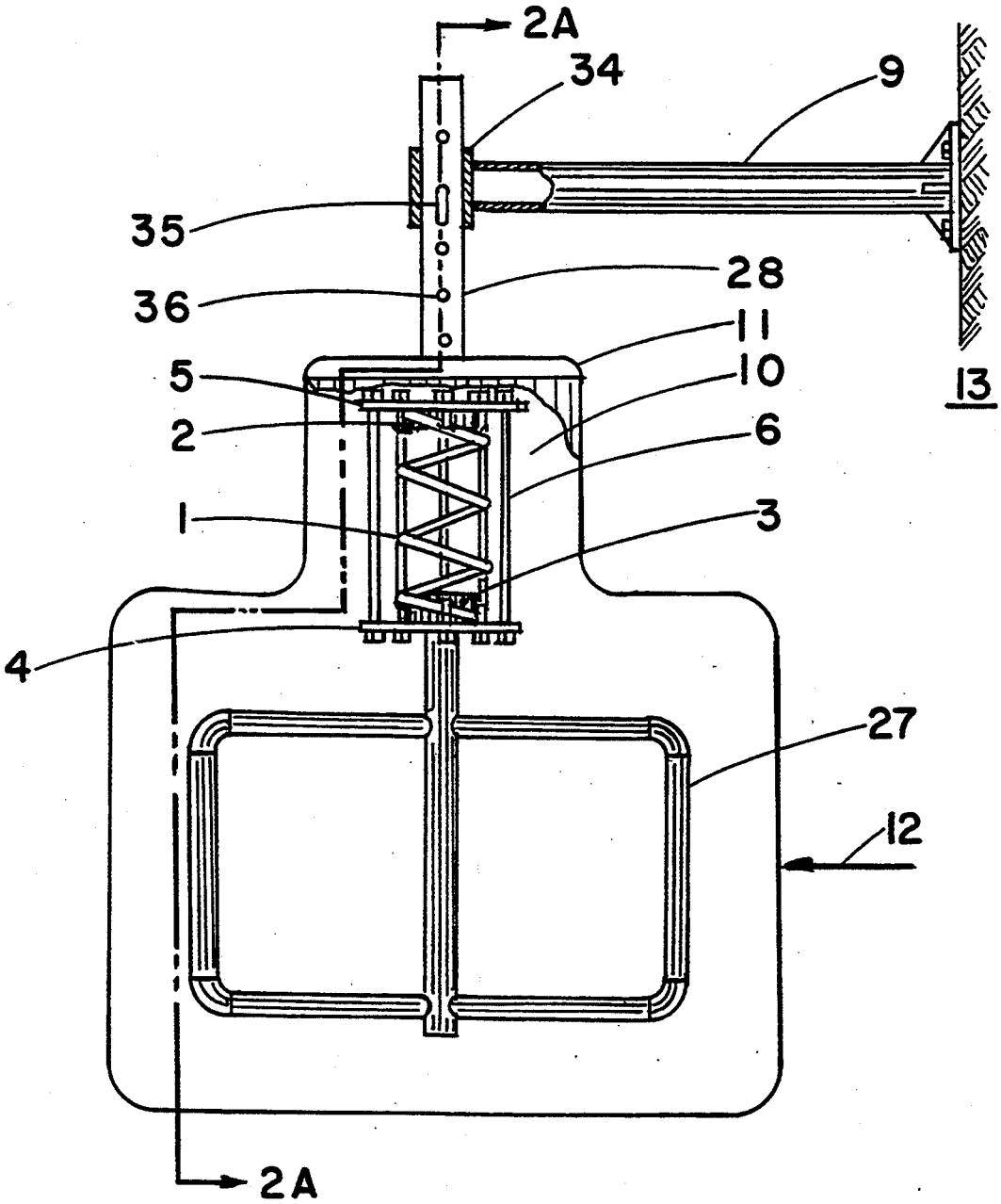
FIG. 2 is a front vertical section through a football and/or martial arts top anchored apparatus constructed in accordance with the present invention.
Figure 2A:
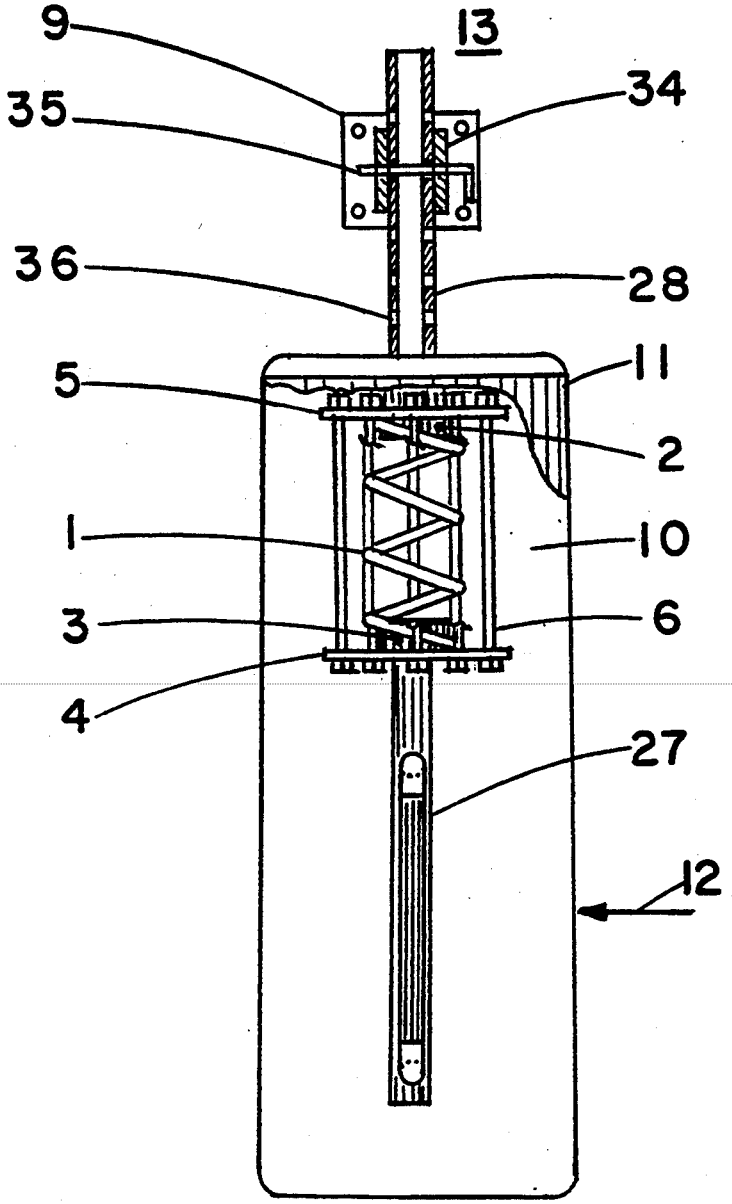

FIG. 2-A is a side sectional elevation of the apparatus illustrated in FIG. 2.

Figure 3:
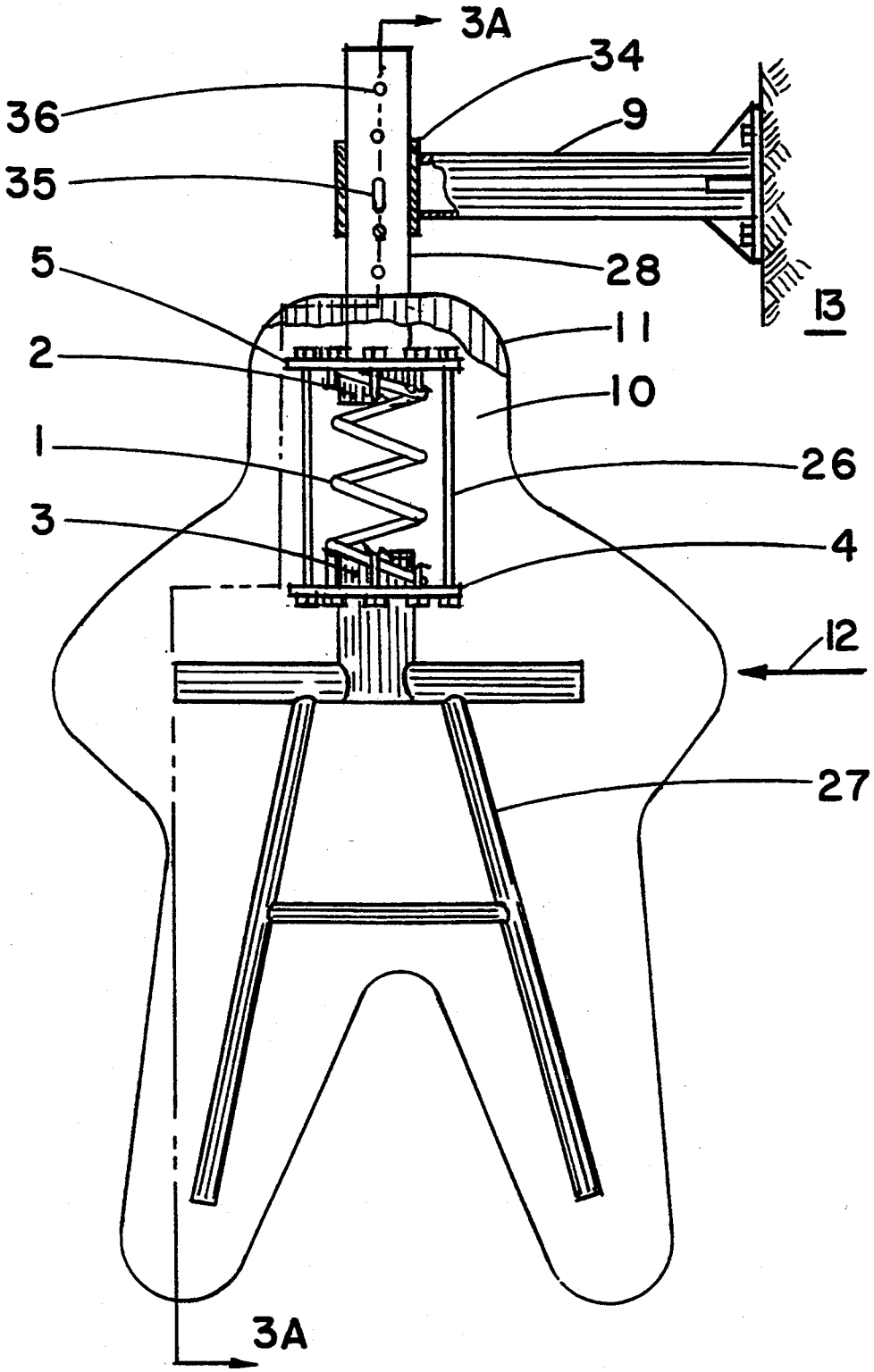
FIG. 3 is a vertical section alternate dummy design to the apparatus demonstrated in FIG. 2.
Figure 3A:
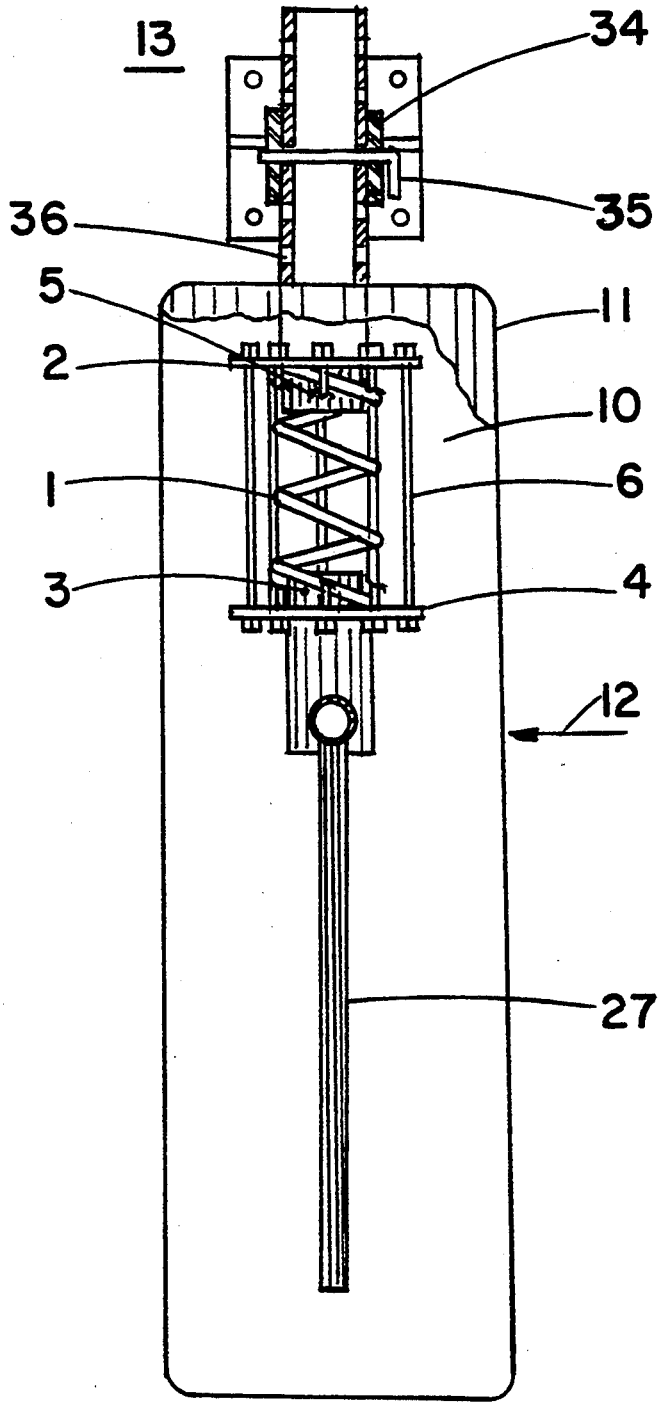

Additional embodiments as shown in FIGS. 3 and 3-A are essentially the same as illustrated in FIGS. 2 and 2-A. The configuration of the dummy is different and the bottom support structure has been modified to suite the dummy shape.

In summary, the invention will provide an athletic training apparatus that will resist and absorb the forces and impact required for football and other contact sports. Further, the invention will reset the apparatus quickly for repeated use. In performing these functions, there will be minimal risk of injury due to a minimum amount of exposed unpadded parts during use and the fail safe design of the mechanism. Because of the portable aspect of the invention, the number of locations it can be used, the ability to reset itself for action and the reduced exposure to injury, the appartus will reduce practice injuries and allow more time for practice thus including more athletes in practice sessions. Athletes normally utilized as defensive people or otherwise to hold pads, reset equipment or be involved individually will be freed to participate in other training. The basic mechanism employing the adjustable or fixed restrained coil compression spring or the like can also be adapted to other training apparatus such as exercise equipment similar to the present state of the art where adjustable or fixed resistance to force is required.

Although the above summary contains many specifics, these should not be construed as limiting the scope of the invention but as merely providing illustrations of some of the present embodiments of the invention. For example, the compression element of the invention can have other shapes such as square, triangular, conical, oval, etc.; or enclosures under air or other compressible medium pressure, etc; the flanges can be square, triangular, oval, etc.; the compression element bases can be set on thrust bearings or other low friction materials; the restraining elements can be chain, rope, linked steel other than chain, non-collapsible sliding members, universal joints, shock absorbers, etc.; the structural elements can be steel, aluminum, plastic, etc.; the configuration of contact elements can depict martial arts figures; soccer players, football players, animals, specific functional shapes, etc.

Thus the scope of the invention should be determined by the appended claims and their legal equivalents, rather than by the examples given.

We claim:

1. An athletic training device comprising, in combination:

a resilient padding;

a cover extending about and completely encasing said padding;

a rigid top member having a first end extending into said padding and in a direction toward a first end of said padding;

an anchoring member having a first end extending into a second end of said padding and a second end extending out of said second end of said padding, and said anchoring member having a means for securement of said second end of said anchoring member to a rigid structure;

a reaction mechanism positioned entirely within said padding and being affixed to a second end of said rigid top member at a first end of said reaction mechanism, and further said reaction mechanism further being affixed to said first end of said anchoring member at a second end of said reaction mechanism, said reaction mechanism comprising a first flange adjacent said first end of said reaction mechanism and a second flange adjacent said second end of said reaction mechanism, a bendable compression element having first and second ends each respectively affixed to one of said first flange and said second flange, means adjacent each of said first and second ends of said compression element for mounting said compression element on an operational axis to and between said top member and said anchoring member, and means for flexibly restraining and dampening movement of said compression element secured about a periphery of said compression element and within said cover;

whereby when said anchoring member is fixed to said rigid base and a force normal to said operational axis is applied to said top member to move said top member from an original equilibrium position, said compression element compresses on a bias and bends in the direction of said force; and whereby upon release of said force, said reaction mechanism acts to restore said top member to return to and maintain said original equilibrium position.

2. The athletic training device recited in claim 1, wherein said compression element is a coil spring of steel.

3. The athletic training device recited in claim 1, wherein said compression element comprises an elastomeric material.

4. The athletic training device recited in claim 1, wherein said means for flexibly restraining and dampening movement of said compression element is flexible and adjustable.

5. The athletic training device recited in claim 1, wherein said means for flexibly restraining and dampening movement of said compression element comprises a plurality of restraints.

6. The athletic training device recited in claim 1, wherein said padding and said cover are made to substantially resemble a human torso.

* * * * *